US007125506B2

(12) United States Patent
Humphries et al.

(10) Patent No.: US 7,125,506 B2
(45) Date of Patent: Oct. 24, 2006

(54) DRAINAGE CHANNEL INSTALLATION DEVICE

(75) Inventors: Derek Humphries, Chardon, OH (US); James McConnell, Orwell, OH (US)

(73) Assignee: ACO Polymer Products, Inc., Chardon, OH (US)

( * ) Notice: Subject to any disclaimer, the term of this patent is extended or adjusted under 35 U.S.C. 154(b) by 0 days.

(21) Appl. No.: 10/872,537

(22) Filed: Jun. 21, 2004

(65) Prior Publication Data

US 2005/0281619 A1 Dec. 22, 2005

(51) Int. Cl.
*E02B 5/02* (2006.01)

(52) U.S. Cl. ..... 264/35; 404/2; 405/118; 249/10

(58) Field of Classification Search ..... 404/2, 404/3, 4; 249/10, 11; 405/118, 119; 264/31, 264/35

See application file for complete search history.

(56) References Cited

U.S. PATENT DOCUMENTS

| | | | | |
|---|---|---|---|---|
| 1,584,756 | A * | 5/1926 | Dougherty | 264/33 |
| 2,305,955 | A | 12/1942 | Dudley | |
| 2,917,804 | A | 12/1959 | Barron | |
| 3,228,679 | A | 1/1966 | Dees | |
| 3,859,000 | A | 1/1975 | Webster | |
| 4,013,021 | A | 3/1977 | Steinlein et al. | |
| 4,337,005 | A | 6/1982 | LeBaron | |
| 4,367,142 | A | 1/1983 | Blecher | |
| 4,522,531 | A * | 6/1985 | Thomsen et al. | 404/2 |
| 4,553,874 | A | 11/1985 | Thomann et al. | |
| RE32,248 | E | 9/1986 | Blecher | |
| 4,884,655 | A | 12/1989 | Freadman et al. | |
| 4,981,395 | A | 1/1991 | Datin et al. | |
| 5,066,165 | A * | 11/1991 | Wofford et al. | 405/119 |
| 5,443,327 | A | 8/1995 | Akkala et al. | |
| 5,518,339 | A | 5/1996 | Shimizu | |
| 5,529,436 | A | 6/1996 | Meyers | |
| 5,538,361 | A | 7/1996 | Beamer | |
| 5,989,417 | A | 11/1999 | Fleischhacker | |
| 6,143,168 | A | 11/2000 | Shackelford | |
| 6,418,861 | B1 | 7/2002 | Flam | |

* cited by examiner

*Primary Examiner*—Sunil Singh
(74) *Attorney, Agent, or Firm*—Pearne & Gordon LLP

(57) ABSTRACT

A drainage channel installation device comprises a channel-securing member and a channel-hanging member. The channel-securing member releasably engages the channel-hanging member and has opposed ends that are adapted to be releasably secured to the opposed side walls of a drainage channel. The channel-hanging-member has both an engaging end that is adapted to releasably engage the channel-securing member and a suspending end that is adapted to receive and retain a suspending member. As a result, when the channel-securing member and the channel-hanging member are releasably engaged, the channel-securing member is releasably secured to the opposed side walls of the drainage channel and the suspending end of the channel-hanging member receives and retains the suspending member, the drainage channel can be suspended from the suspending member for installation of the drainage channel. The drainage installation device is reusable and allows the drainage channel to be positioned within a trench at any desired level.

9 Claims, 2 Drawing Sheets

DRAINAGE CHANNEL INSTALLATION DEVICE

BACKGROUND OF THE INVENTION

Prefabricated linear drainage channels, or trench drains, frequently are employed to collect and carry away surface water and other liquid materials from parking lots, factory floors, side walks, driveways and other surfaces. Typically, the drainage channels are constructed so as to have two side walls joined at their bottoms by bottom walls. The tops of the side walls are provided with ledges that support a grating. Normally, the drainage channel is positioned slightly lower than the surface from which water or some other liquid is to be collected and carried away. As a result, the surface water, or other liquid, flows to the top of the drainage channel, through the grating and down to the bottom of the drainage channel from where it is conveyed to a disposal site. It is usually the case that the drainage channels are fabricated in units of a length that allow the channels to be readily handled. At the same time, ordinarily, it is necessary to convey the collected surface waters a distance greater than the length of any individual unit. Consequently, the drainage units must be arranged end-to-end so that the surface water can be conveyed the requisite distance for appropriate disposition.

Typically, the drainage channels are installed in a trench that is created in the surface from which surface water is to be collected and carried away. The trench is wider and deeper than the width and height of the drainage channels which are arranged end-to-end in the trench at an appropriate height above the bottom of the trench. The drainage channels are supported in the trench in that fashion while a filler material such as concrete or asphalt is introduced into the open space between the trench and the drainage channels. Once the filler material has set or hardened and the drainage channels are fixed in place, the gratings are installed and the drainage channels can be placed into service.

A variety of devices and methods are known for the purpose of supporting the drainage channels in the trench while the filler material is introduced into the open space between the drainage channels and the trench. Several considerations that are relevant with respect to the implementation of any particular supporting device or method are as follows: (1) By not locating the supporting devices in the trench and fashioning the devices so as to be removable, they will not become embedded in the filler material when it hardens and can be reused. (2) The devices and methods, preferably, will allow the tops of the drainage channels to be readily set at any desired level so as to insure that surface water will flow into the drainage channels when they are put into service. (3) The supporting devices and methods will keep the drainage channels from floating and shifting under the influence of the filler material as it is introduced into the open space between the trench and the drainage channels. (4) The supporting devices and methods will be such that any tendency for the drainage channel side walls to collapse toward one another as a result of the pressure of the filler material will be minimized.

SUMMARY OF THE INVENTION

Each of the considerations set forth above that are relevant to supporting devices and methods employed in connection with the installation of drainage channels are addressed by the present invention. The supporting devices of the invention are not consumed during installation and can be reused. Additionally, the drainage channels can be readily positioned at any desired height within the trench in which the channels are to be installed using the supporting devices and methods of the present invention. Also, if required, the side walls of the drainage channel can be supported applying a particular aspect of the present invention so as to minimize the likelihood of their collapsing toward one another when the filler material is introduced into the space between the trench and the drainage channels. Further, by employing a specific aspect of the present invention, floating and/or shifting of the drainage channels can be negated.

According to one aspect of the invention, a drainage channel installation device comprises a channel-securing member and a channel-hanging member. The channel-securing member has opposed ends that are adapted to be releasably secured to the opposed side walls of a drainage channel and a means for releasably engaging the channel-hanging member. The channel-hanging member has both an engaging end that is adapted to releasably engage the channel-securing member and a suspending end that is adapted to receive and retain a suspending member. As a result, when the channel-securing member and the channel-hanging member are releasably engaged, the channel-securing member is releasably secured to the opposed side walls of the drainage channel and the suspending end of the channel-hanging member receives and retains the suspending member, the drainage channel can be suspended from the suspending member. According to a particular aspect of the invention, the channel-securing member is of a length, and its opposed ends are of a dimension, adapted to fit within recesses located within the opposed side walls of the drainage channel.

According to another aspect of the invention, the engaging end and the suspending end of the channel-hanging member of the installation device are joined by an intermediate portion of the channel-hanging member and spacing arms are located on the intermediate portion of the channel-hanging member. The spacing arms are adapted to span the width of and engage the opposed side walls of the drainage channel to prevent movement of the side walls toward one another when the installation device is releasably secured to the drainage channel.

According to a further aspect of the invention, the channel-securing member includes a top surface and opposed side surfaces, and the means for releasably engaging the channel-hanging member comprises a cavity disposed in at least one of the side surfaces and extending through the top surface of the channel-securing member. A portion of the cavity that is distal from the top surface is wider than a portion of the cavity at the top surface. The engaging end of the channel-hanging member includes a foot portion that is shaped to slidably fit into the cavity via the side surface in which the cavity is disposed and be retained within the cavity. In a specific aspect of the invention, the foot portion forms a dovetail fitting with the cavity in the channel-securing member when the channel-securing member and the channel-hanging member are engaged.

According to still another aspect of the invention, the channel-hanging member includes a suspending unit that is attached to the intermediate portion of the channel-hanging member and the suspending unit includes means for retaining the suspending member in a position transversely of the drainage channel to which the drainage channel installation device is releasably secured and providing a suspending surface from which the drainage channel installation device and the drainage channel can be suspended from the suspending member. In a specific aspect of the invention, the means for retaining the suspending member in a position transversely of the drainage channel to which the drainage channel installation device is releasably secured and providing a suspending surface from which the drainage channel installation device and drainage channel can be suspended from the suspending member comprises a pair of substantially parallel first and second retaining elements that extend, generally, parallel to a line joining the opposed ends of the channel-securing member and away from the intermediate portion of the channel-hanging member and a third retaining element that is attached to and extends, generally, orthogonally from at least one of the first and second retaining elements toward the other of the first and second retaining elements. The first, second and third retaining elements are spaced apart a distance sufficient to receive the suspending member which in a further particular aspect of the invention comprises a two-by-four piece of lumber.

According to an additional aspect of the invention, the drainage channel installation device includes means for releasably locking said channel-securing and channel-hanging members together when the means for releasably engaging said channel-hanging member and the securing end of the channel-hanging member are releasably engaged. To accomplish this result, each of said channel-securing and channel-hanging members can include a respective flange having a through-hole. The flanges are disposed on the channel-securing and channel-hanging members so that the through-holes substantially align when the channel-securing member is engaged to the channel-hanging member, whereby disposition of a locking pin within the through-holes prevents the channel-securing and channel-hanging members from disengaging. The locking pin can be retained on the channel-hanging member when it is not disposed within the through-holes. Additionally, to facilitate the placement of the locking pin, the suspending end of the channel-hanging member can be located on the channel-hanging member so as to provide a, substantially, vertical unencumbered line-of-sight to the through-holes from above the suspending end of the channel-hanging member when the drainage channel is suspended by the suspending member.

Another aspect of the invention involves a method of installing a drainage channel in a trench that is disposed between two supporting surfaces and wherein the drainage channel has a pair of opposed side wall portions that have substantially parallel opposed inner side wall surfaces that include installation device-engaging structures for releasably engaging an installation device. The method comprises, releasably securing opposed ends of at least one channel-securing member to the opposed inner side wall surfaces by means of the installation device-engaging structures, releasably securing a respective channel-hanging member to each channel-securing member, each channel-hanging member including a suspending unit for receiving and retaining a suspending member transversely of the opposed side walls of the drainage channel. A suspending member that has opposed ends and is of a length sufficient to span the trench is disposed in the suspending unit. Each opposed end portion of the suspending member is rested on a respective one of the supporting surfaces, whereby the drainage channel is suspended within the trench. Thereafter, a fluid material capable of solidifying and maintaining the drainage channel in place in the trench is introduced into a region of the trench surrounding the drainage channel.

According to yet other aspects of the invention relating to a method of installing the drainage channel: the suspending member can be disposed in the suspending unit prior to the channel-hanging member being secured to the channel-securing member; the opposed end portions of the suspending member can be rested directly on the supporting surfaces; a plurality of the channel-securing, channel-hanging and suspending members can be employed; the relative movement of the side walls of the drainage channel toward one another upon introduction of said fluid material can be prevented, including by action of a portion of the channel-hanging member in engagement with the opposed side wall portions of the drainage channel; the channel-hanging member, as well as the channel-securing member, can be removed from the drainage channel after the fluid material is introduced into the trench; and a piece of two-by-four lumber can be employed as the suspending member.

BRIEF DESCRIPTION OF THE DRAWINGS

The foregoing and other features of the present invention will be apparent from the description below with reference to the drawings wherein.

DETAILED DESCRIPTION OF THE INVENTION

Figure 1:
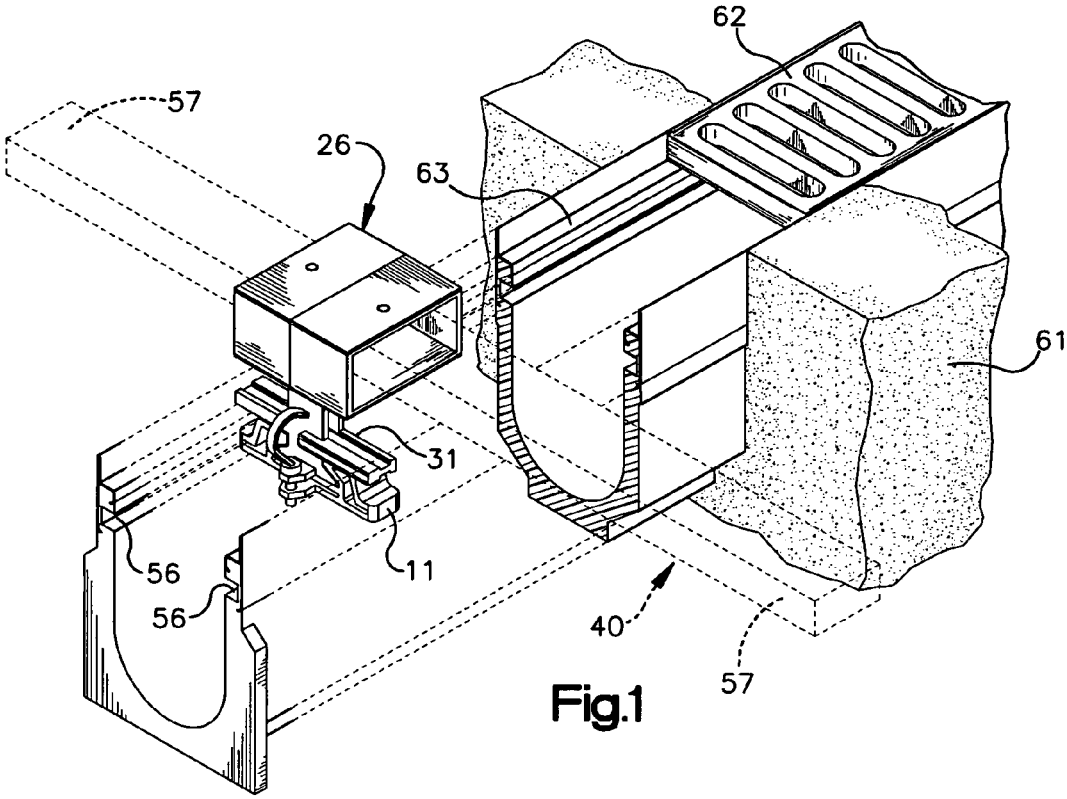
FIG. 1 is a perspective view of the drainage channel installation device of the invention, illustrating the manner in which the device is secured to and supports a drainage channel so that the drainage channel may be permanently installed.
Figure 2:
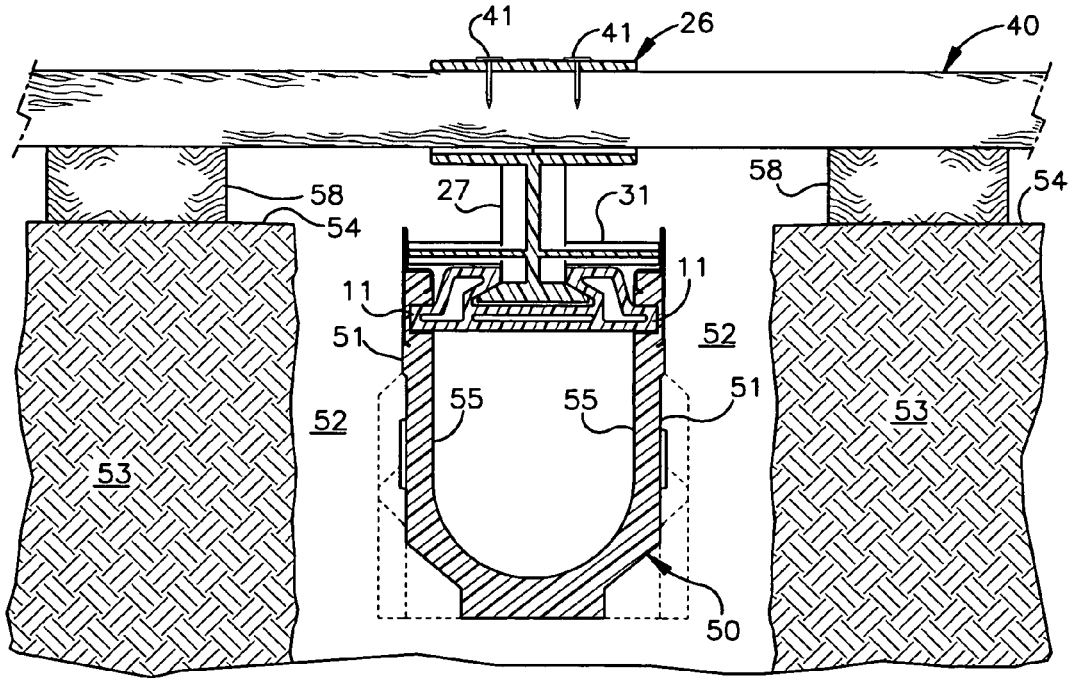
FIG. 2 is a cross-sectional end view of the drainage channel device of the present invention secured to a drainage channel, illustrating certain details of the manner in which the device supports the drainage channel from adjacent supporting surfaces.
Figure 3:
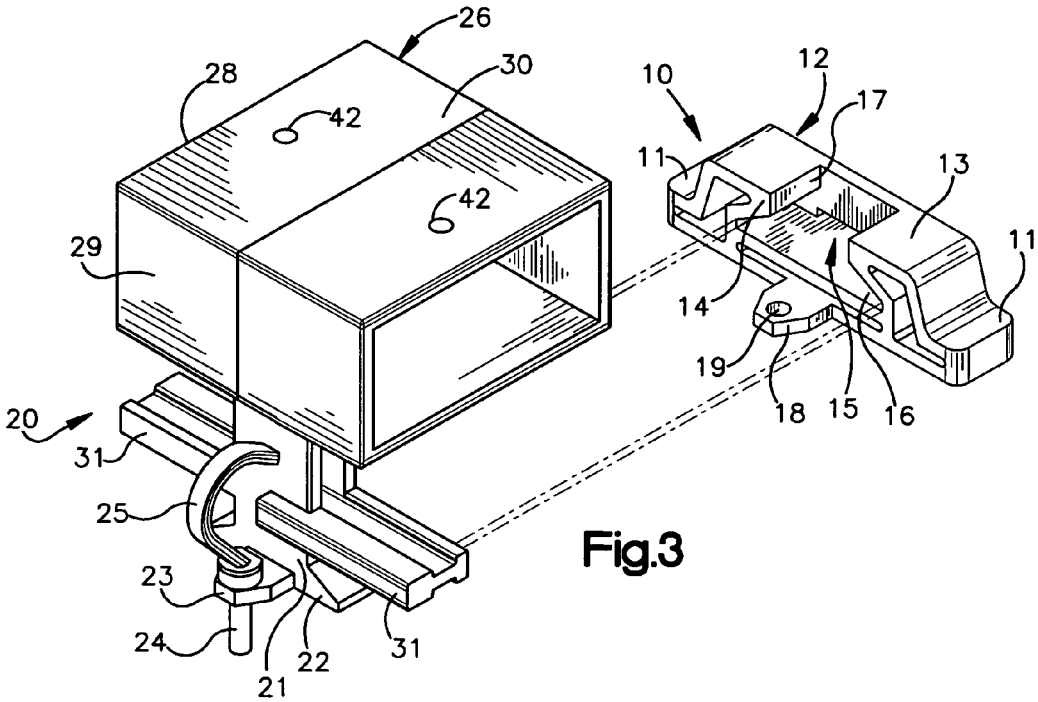
FIG. 3 is perspective view of the drainage installation device of the invention, illustrating the channel-securing and channel-hanging components that comprise the device prior to being joined to one another and secured to a drainage channel.

Referring to the drawings, the presently preferred embodiment of the drainage channel installation device of the invention, and the method of installing a drainage channel, will first be described, primarily, with reference to FIGS. 3, 4 and 5. These three figures illustrate the installation device apart from being releasably secured to a drainage channel for installation of the channel. FIGS. 1 and 2 illustrate the installation device as releasably secured to the side walls 51 of the drainage channel, indicated generally at 50, and supporting the channel in a trench for the purpose of installing the channel and a detailed description of the invention with reference to FIGS. 1 and 2 is presented subsequently below.

The drainage channel installation device of the invention comprises a channel-securing member, indicated generally at 10, and a channel-hanging member, indicated generally at 20, that are releasably secured to one another when the installation device is in place on a drainage channel. In the present embodiment, both the channel-securing member and the channel-hanging member are constructed of a plastic material, such as a high density polyethylene or polypropylene, although they may be formed of nylon or non-plastic materials such as metals.

The function of the channel-securing member 10 is to releasably secure the drainage channel installation device to the drainage channel when the members 10 and 20 are releasably joined. For this purpose, the member 10, generally, is configured as an elongate bar having two opposed ends 11 that are adapted to be releasably secured to the opposed side walls of a drainage channel in a manner described in greater detail below. The intermediate portion 12 of the member 10 that lies between the opposed ends 11 is raised above the opposed ends so as to have a greater thickness than the thickness of each of the ends 11. This configuration of the opposed ends 11 and intermediate portion 12 of the member 10 facilitates the releasable securing of the channel-hanging member 20 to the member 10 and the releasable securing of the member 10 to the drainage channel as will be apparent from the description set forth below. The intermediate portion 12 of the member 10 includes a top surface 13 and opposed side surfaces 14 and 14*a*. A cavity 15 is disposed in at least one of the side surfaces 14 and 14*a* and extends through the top surface 13 of the member 10 and serves as a means on the channel securing member 10 for releasably engaging the channel-hanging member 20. In the embodiment of the invention shown in the figures, the cavity is disposed in side surface 14. The portion 16 of the cavity that is distal from the top surface 13 is wider than the portion 17 of the cavity at the top surface 13.

The channel-hanging member 20 includes an engaging end 21 that is adapted to releasably engage the channel-securing member. Specifically, engaging end 21 includes a foot portion 22 that has a shape that is congruent with the shape of the cavity 15, but slightly smaller than the cavity, so that the foot portion 22 can slidably fit into the cavity 15 via side surface 14 and be retained within the cavity 15. As will be understood, this configuration of the foot portion 22 and the cavity 15 and the sliding connection between them allows the members 10 and 20 to be releasably secured together. In the embodiment of the invention shown in the drawings, the foot portion 22 forms a dovetail fitting with the cavity 15 when the channel-securing member 10 and the channel-hanging member 20 are engaged. However, the precise configuration and shape of each of the foot portion 22 and the cavity 15 may vary from the precise dovetail shape of the foot portion and the corresponding mortise of the cavity illustrated in the drawings. The important consideration is that there be a releasable connection between the channel-securing member and the channel-hanging member.

The channel-hanging member 20, in addition to having an engaging end 21 for releasably securing the member 20 to the channel-securing member 10, has a suspending end, indicated generally at 26, adapted to receive and retain an elongate suspending member (shown at 40 in FIGS. 1 and 2) that is oriented transversely of the drainage channel to which the installation device is releasably secured. As best illustrated in FIGS. 1 and 2, when (1) the channel-securing member 10 and the channel-hanging member 20 are releasably engaged to form the installation device of the invention, (2) the channel-securing member 10 is releasably secured to the opposed side walls 51 of the drainage channel 50, and (3) the suspending end 26 of the channel-hanging member 20 receives and retains the suspending member 40, the drainage channel 50 can be suspended from the suspending member 40.

In the embodiment of the invention shown in the drawings, the engaging end 21 and the suspending end 26 of the channel-hanging member 20 are joined by an intermediate portion 27 of the channel-hanging member 20 and spacing arms 31 are located on the intermediate portion 27 of the channel-hanging member 20. The spacing arms are adapted to span the width of and engage the opposed side walls 51 of the drainage channel 50 to prevent movement of the side walls toward one another when the installation device is releasably secured to the drainage channel 50 as shown in FIGS. 1 and 2.

The suspending end 26 of channel-hanging member 20, in the embodiment of the invention shown in the figures, includes a suspending unit 28 that is attached to the intermediate portion 27 of the channel-hanging member 20. In general, the suspending unit comprises an open box-like structure having a pair of substantially parallel first and second retaining elements, or side walls, 29 that extend, generally, parallel to a line joining the opposed ends 11 of the channel-securing member 10, when the members 10 and 20 are engaged, and away from the intermediate portion 27 of the channel-hanging member 20. The first and second retaining elements 29 are attached to the intermediate portion 27 of the channel-hanging member 20 by bottom wall 32 and are spaced apart a distance sufficient to receive and retain the suspending member 40 as illustrated in FIGS. 1 and 2.

A third retaining element, or upper wall, 30 is attached to and extends, generally, orthogonally from at least one of the first and second retaining elements 29 and toward the other of the first and second retaining elements. In the embodiment of the invention illustrated in the drawings, the third retaining element 30 extends orthogonally from both retaining elements 29 as a continuum. The third retaining element 30 and bottom wall 32 are spaced apart a distance sufficient to receive and retain the suspending member 40 as illustrated in FIGS. 1 and 2.

The suspending unit 28 and the suspending member 40 may assume a variety of configurations as will be understood by one having ordinary skill in the art. What is preferred is that the suspending unit 28 include means, such as the first and second retaining members 29, for retaining the suspending member 40 in a position, substantially, transversely of the drainage channel 50 to which the drainage channel installation device is releasably secured and providing a suspending surface, such as third retaining element 30, from which the drainage installation device and drainage channel 50 can be suspended from the suspending member 40. As will be understood by those skilled in the art, the suspending surface need not comprise a wall 30 that joins the first and second retaining members 29. Other means such as, for example, projections emanating outwardly from the retaining elements 29 toward one another or fasteners on the retaining elements 29 can provide the suspending surface for the suspending member 40. In the presently preferred embodiment of the invention, as shown in the drawings, the suspending member 40 comprises a two-by-four piece of lumber. Consequently, the spacing between the first, second and the third retaining elements is dimensioned so as to accommodate the two-by-four piece of lumber.

To assist in maintaining the channel-securing member 10 and the channel-hanging member 20 releasably secured to one another and prevent the members 10 and 20 from disengaging when the channel-hanging member and the channel-securing member are releasably engaged, means are provided for releasably locking the two members together.

Figure 4:
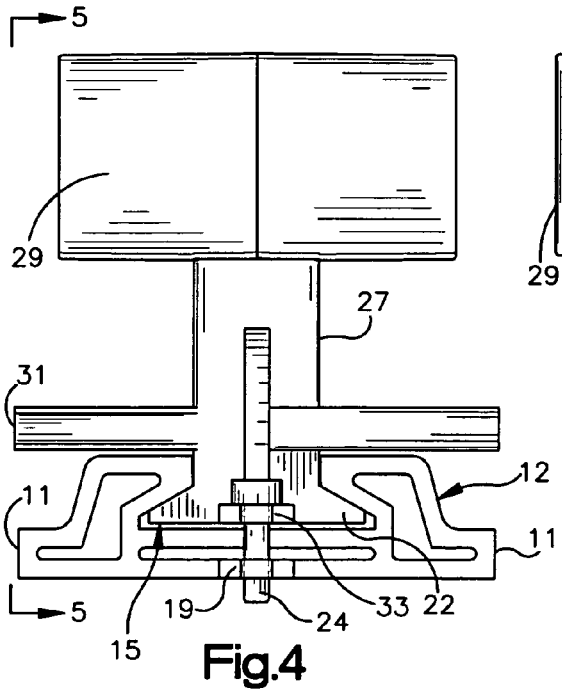
FIG. 4 is a front elevational view of the drainage channel installation device of the invention.
Figure 5:
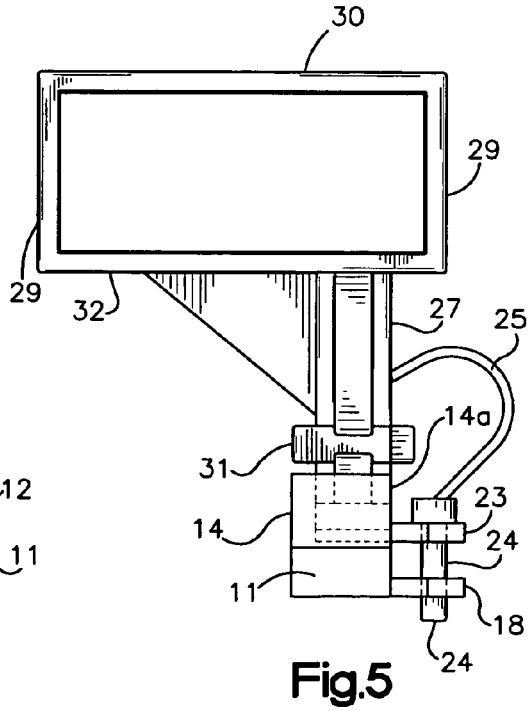
FIG. 5 is a side elevational view of the drainage channel installation device of the invention along the lines 5—5 of FIG. 4.

Specifically, as best shown in FIGS. 1, 4 and 5 a projection, or flange, 18 having a through-hole 19 is located on the channel-securing member 10 below the distal end of cavity 15 so as to extend substantially perpendicularly away from side 14 of the member 10. A similar projection, or flange, 23, also having a through-hole 33, is located on the channel-hanging member 20 50 as to extend substantially perpendicularly away from foot portion 22 of member 20. The flanges 18 and 23 are disposed on the channel-securing and channel-hanging members, respectively, so that the through-holes 19 and 33 substantially align when the channel-securing member is engaged to the channel-hanging member, whereby the disposition of a locking pin 24 within the through-holes 19 and 33 prevents the channel-securing and channel-hanging members from disengaging. As is best shown in FIG. 3, the locking pin 24 is retained on the channel-hanging member 20 in through-hole 33 when the channel-securing member and the channel-hanging member are not releasably engaged. So that the locking pin 24 is not misplaced, preferably, it is attached to the intermediate portion 27 of the channel-hanging member 20 by a flexible strap 25 in the embodiment of the invention illustrated in the drawings.

Although it is not essential, preferably, as best illustrated in FIGS. 1 and 5, the suspending end 26 of the channel-hanging member 20 is located on the channel-hanging member so as to provide a substantially vertical unencumbered line-of-sight to the through holes 19 and 33 from above the suspending end 26 when the drainage channel 50 is suspended by the suspending member 40. This arrangement facilitates the task of inserting the locking pin 24 into the holes 19 and 33.

Reference will now be had to FIGS. 1 and 2 for the purpose of describing in greater detail the manner in which the invention is employed in installing a drainage channel. FIG. 1 illustrates a composite of conditions that exist in connection with the installation of a drainage channel in accordance with the invention. In other words, a first portion of FIG. 1 depicts a drainage channel as it would exist after having been installed in a trench and a second portion of FIG. 1 depicts a drainage channel as it would exist when suspended in a trench by the installation device of the present invention and prior to being fixed in placed. FIG. 2 augments the depiction of the invention in the second portion of FIG. 1.

In the first portion of FIG. 1, the drainage channel 50 is shown as being fixed in place by a fluid material, such as concrete, that has solidified into a solid mass 61. The drainage channel installation device employed to install the drainage channel has been removed and a grating 62 has been placed on a seat 63 at the top of the drainage channel. In the second portion of FIG. 1, drainage channel 50 is shown in position for installation in a trench 52 constructed in the ground 53. For this purpose, the drainage channel 50 is positioned in the trench 52 and is supported there by the suspending member 40 which rests on two supporting surfaces 54 on the surface of the ground 53. A typical installation will comprise a number of the drainage channels arranged end-to-end, and a plurality of installation devices will be employed for satisfactorily maintaining the drainage channels in proper alignment in a trench while concrete, asphalt or some other fluid material capable of solidifying and maintaining the channels in place is introduced into the trench.

Referring particularly to FIG. 2, the drainage channel 50 is shown as including a pair of opposed side wall portions 51 having substantially parallel opposed inner side wall surfaces 55 that include installation device-engaging structures in the form of recesses 56 for releasably engaging the drainage channel installation device. The method of installing the drainage channel comprises releasably securing opposed ends 11 of at least one channel-securing member 10 to the opposed inner side wall surfaces 55 by means of the installation device-engaging structures 56, and releasably securing a respective channel hanging-member 20, including a suspending unit 26 for receiving and retaining the drainage channel suspending member 40 transversely of the side walls 51 of the drainage channel 50, to each of the channel-securing members 10. As will be understood from the description set forth above with reference to FIGS. 3,4 and 5, in the embodiment of the invention shown in the drawings, a respective channel-hanging member 20 is releasably secured to a channel-securing member 10 by the engagement of foot portion 22 of the channel-hanging member and the cavity 15 of the channel-securing member.

A suspending member 40 is disposed on the box-like suspending unit 26 by passing the member, which, as described above, can comprise a two-by-four piece of lumber, through the open sides of the suspending unit. As shown in the drawings, the suspending member 40 is of a sufficient length that its opposed ends 57 span the trench 52. The suspending member 40 may be disposed on the suspending unit 26 either prior to or after the channel-hanging member 20 is releasably secured to the channel-securing member 10. If desired, suspending member 40 can be secured to the suspending unit 26 by means of fasteners 41 that are inserted through the holes 42 in the upper wall 30.

Each opposed end portion of the suspending member 40 rests on a respective one of the supporting surfaces 54, whereby the drainage channel 50 is suspended within the trench. At such a time as the drainage channel is properly placed within the trench, a fluid material capable of solidifying and maintaining the drainage channel in place in the trench is introduced into the region of the trench surrounding the drainage channel. In the embodiment of the invention shown in the drawings, the suspending member 40 is illustrated as resting on wooden blocks 58 so that the very top of the side walls of the drainage channel will be located slightly below the surface 54. With such an arrangement, the fluid material, as it solidifies, can be configured to slope downwardly from the surface 54 to the top of the drainage channel to insure that surface water from surface 54 will flow into the drainage channel. However, depending on a variety of factors, such as the dimensions of the installation device and the drainage channel, the location of the recesses 56 below the top edge of the drainage channel and the degree of slope desired between the surface 54 and the top of the drainage channel, supports such as the wooden blocks 58 may not be required and the suspending member 40 may rest directly on the surfaces 54.

As will be understood by one having ordinary skill in the art, the fluid material introduced into the trench will exert pressure on the side walls 51 of the drainage channel tending to collapse the walls inwardly of the channel. The relative movement of the side walls toward one another upon the introduction of the fluid material into the trench is prevented, according to the invention, such as, for example, by the portion 31 of the channel-hanging member 20 that is in engagement with the opposed side wall portions 51 of the drainage channel. Additionally, the fluid material can exert a buoyant force on the drainage channel 50 and move the channel out of alignment. To prevent such an occurrence, weighted material can be placed on the suspending member

40, particularly above the locations where the suspending member rests on the surfaces 54.

Both the channel-securing member 10 and the channel-hanging member 20 are reusable and, consequently, after the fluid material has been introduced into the trench and the members are no longer required, they may be removed from the drainage channel. Reuse of the members reduces the cost of installation, particularly where a plurality of channel-securing and channel-hanging members are used for each drainage trench unit as can be the case.

Modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A method of installing a drainage channel in a trench disposed between two supporting surfaces, said drainage channel including a pair of opposed side wall portions having substantially parallel opposed inner side wall surfaces that are spaced from one another by a width of the channel, said parallel side wall surfaces including installation device-engaging structures for releasably engaging an installation device, the method comprising:

a) releasably securing opposed ends of at least one channel-securing member to said opposed inner side wall surfaces by means of said installation device-engaging structures such that the channel-securing member spans the entire width between the parallel side wall surfaces, said channel-securing member including a top surface, opposed side surfaces, and a cavity disposed in at least one of said side surfaces of the channel-securing member and extending through said top surface, a portion of said cavity distal from said top surface being wider than a portion of said cavity at said top surface;

b) releasably securing a foot portion of a respective channel-hanging member to said cavity of at least one channel-securing member by fitting said foot portion into said cavity via said side surface in which said cavity is disposed, said channel-hanging member including a suspending unit for receiving and retaining a suspending member transversely of said opposed side wall portions of said drainage channel;

c) disposing said suspending member in said suspending unit, said suspending member having opposed end portions and being of a length sufficient to span said trench;

d) resting each said opposed end portion of said suspending member on a respective one of said supporting surfaces, whereby said drainage channel is suspended within said trench; and e) introducing into a region of the trench surrounding said drainage channel a fluid material capable of solidifying and maintaining said drainage channel in place in the trench.

2. The method of claim 1 wherein said suspending member is disposed in said suspending unit prior to securing said foot portion to said cavity.

3. The method of claim 1 wherein said opposed end portions of said suspending member are rested directly on said supporting surfaces.

4. The method of claim 1 wherein a plurality of said channel-securing, channel-hanging and suspending members are employed.

5. The method of claim 1 including preventing the relative movement of said opposed side walls of the drainage channel toward one another upon introduction of said fluid material into said region of the trench surrounding said drainage channel.

6. The method of claim 5 including preventing said relative movement by action of a portion of said channel-hanging member in engagement with said opposed side wall portions of said drainage channel.

7. The method of claim 1 including removing said channel-hanging member from said drainage channel after said fluid material is introduced into said trench.

8. The method of claim 7 including removing said channel-securing member from said drainage channel after said fluid material is introduced into said trench.

9. The method of claim 1 including using a piece of two-by-four lumber as said suspending member.

* * * * *